US005978318A

United States Patent [19]

Kawaguchi et al.

[11] Patent Number: 5,978,318

[45] **Date of Patent: *Nov. 2, 1999**

[54] TIMEPIECE DEVICE MECHANISM FOR INDICATING RESTART AFTER RECHARGING

[75] Inventors: Takashi Kawaguchi; Masaru Kubota, both of Nagano-ken, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/975,289

[22] Filed: Nov. 20, 1997

[30] Foreign Application Priority Data

Nov. 22, 1996 [JP] Japan ..... 8-327687

[51] Int. Cl.[6] ..... G04B 9/00; G04B 1/00

[52] U.S. Cl. ..... 368/66; 368/204

[58] Field of Search ..... 368/64, 66, 203–205

[56] References Cited

U.S. PATENT DOCUMENTS

| | | | |
|---|---|---|---|
| 3,998,043 | 12/1976 | Tamaru et al. | 368/66 |
| 4,223,522 | 9/1980 | Nomura et al. | 368/66 |
| 4,262,349 | 4/1981 | Sekiya et al. | 368/71 |
| 4,398,832 | 8/1983 | Maire et al. | 368/76 |
| 4,714,352 | 12/1987 | Ganter . | |
| 5,446,702 | 8/1995 | Mossuz et al. | 368/37 |

FOREIGN PATENT DOCUMENTS

| | | |
|---|---|---|
| 0 766 150 | 4/1997 | European Pat. Off. . |
| 62-194484 | 8/1987 | Japan . |
| 63-148193 | 6/1988 | Japan . |

*Primary Examiner*—Vit Miska
*Attorney, Agent, or Firm*—Stroock Stroock & Lavan LLP

[57] ABSTRACT

A timepiece device mechanism for indicating the restart of pointer movements after recharging following a halt condition. The timepiece device includes a display for displaying time information wherein the display is driven by a display-drive. A termination-detector monitors the operation of the display and outputs a termination detection signal when detecting a halt of the display. A storage unit receives and holds the termination detection signal and outputs a termination-storage signal in response thereto. A power supply outputs a voltage and a power-supply-voltage detector detects the voltage-level output of the power supply and outputs a power-supply-voltage detection signal when the voltage is greater than or equal to a first reference voltage that is higher than a movement-start voltage. A modulation signal generator receives the termination storage signal and power-supply-voltage detection signal and outputs a modulation signal when the power-supply-voltage detection signal is output while the termination-storage signal is being input to the modulation-signal generator. The display-drive receives the modulation signal and performs modulated driving of the display in response thereto.

16 Claims, 10 Drawing Sheets

CHARGING
DISCHARGING
POWER-SUPPLY VOLTAGE
TIME
$V_{SS}$
$V_2$
$V_1$
0
0
$T_1$
$T_2$
$T_3$
$T_4$
$T_5$
a
b
c
d
e
f
g
p
$B_1$
$B_2$

TIMEPIECE DEVICE MECHANISM FOR INDICATING RESTART AFTER RECHARGING

BACKGROUND OF THE INVENTION

The present invention relates to a timepiece device provided with a rechargeable power-generator mechanism and in particular to a mechanism for indicating that timepiece pointer movement has resumed following a halt condition.

Conventional timepiece devices that provide a power-generator mechanism for generating necessary electrical energy for timepiece driving are currently in use and under development. Power-generator mechanisms of this type include those that use solar cells to charge a rechargeable battery. Others, including wristwatches, recharge a rechargeable battery with the output of a built-in, automatically-activated power-generator mechanism which generates power in accordance with the natural movement of the user's hand. Normally, if the timepiece device is moved or shaken, the rechargeable battery is sufficiently charged and the timepiece-device pointers are driven at a velocity which represents the passage of time.

However, if the timepiece device is not moved, the rechargeable battery will no longer receive charge from the power-generating mechanism, and because the pointers are still being driven, the rechargeable battery will eventually be drained of charge. As a result, the normal movements of pointers will cease and the timepiece device enters into a halt condition. When the timepiece device is then moved or shaken, the power-generating mechanism starts recharging the battery, and the pointers' movement resumes.

A problem associated with timepiece-devices of this type is that the timepiece-device user may not realize that pointer movement has resumed from a halt. For example, in a timepiece device with two pointers, a minute and an hour pointer, pointer movement is too slow to be recognized by the user for the user to recognize by glancing at the timepiece device that pointer movement has halted or restarted. Therefore, the user may not realize that battery recharging and pointer movement has resumed following a halt condition.

To overcome this drawback, timepiece devices include "modulated movements of pointer" in which at least one pointer is driven at a faster than normal velocity. Modulated movements of pointers occurs when charging of the rechargeable battery has resumed after a halt condition. Modulating the pointers in such a manner informs the user that pointer movement has just resumed from a halt condition.

A drawback in using this technique is that the modulated movement of pointers consume more power than normal movements of pointers and may cause the rechargeable battery to drain faster than the battery can be recharged. Thus, if modulated movement of pointers is initiated immediately after the rechargeable battery has resumed charging following a halt condition, the battery charge will be quickly drained to a level that is below what is necessary for activating the timepiece device. This causes the modulated movement of pointers to terminate and the timepiece device to reenter into a halt condition. Therefore, by starting modulated movement of pointers immediately after the resumption of battery recharging following a halt condition, it is impossible to ensure secure and reliable timepiece pointer movements.

Another problem with prior art devices that use the modulated movement of pointers technique is that timepiece device batteries do not always charge uniformly and the charge contained in these batteries may fluctuate irregularly. Also, some batteries have a superficial charging voltage that is different from the real charging voltage and therefore does not reflect the real charging condition of the battery. In these situations, the timepiece device may initiate modulated movements of pointers after a halt condition even though the amount of charge in the battery cannot sustain modulated pointer movements.

Therefore, it is desired to provide a timepiece device in which modulated movements of pointers can be used to inform the user that the timepiece device has restarted from a halt condition while also maintaining reliable and secure pointer movements following a halt condition.

SUMMARY OF THE INVENTION

A timepiece device which informs a user when timepiece movements have resumed after a halt condition and which can continue timepiece movements securely and reliably is provided. In accordance with the present invention, the timepiece device includes a display for displaying time information. A display-drive drives the display. A termination-detector detects a halt of the display and outputs a termination-detection signal. A storage unit receives the termination detection signal and holds and outputs a termination-storage signal to a modulation-signal generator in response thereto. A power-supply-voltage detector outputs a power-supply-voltage detection signal when the power-supply voltage from a power-supply is greater than or equal to a first reference voltage that is higher than a movement-start voltage. The modulation-signal generator outputs a modulation signal for initiating a modulated driving start of the display in response to the power-supply-voltage detection signal from the power-supply-voltage detector and the termination-storage unit signal from the storage unit. The display-drive then performs modulated driving of the display, indicative of a prior halt of display, based on the modulation signal.

The modulated driving of the display is different from conventional timepiece driving and allows a user to visually and/or acoustically recognize the resumption of timepiece movements from a halt condition.

The modulation-signal generator preferably terminates generating the modulation signal under given conditions. For example, in one embodiment, modulated driving may be terminated based on the comparison between supply voltage and a reference voltage. In another embodiment, modulated driving may be terminated when the modulated driving is performed for a predetermined time, or modulated driving may be terminated on the condition that a user adjusts the displayed time.

According to the present invention, the first reference voltage for causing the display to start modulated driving is set to a value higher than the movement-start voltage for this timepiece device, i.e., a voltage at which timepiece movement can be stably performed. This prevents modulated driving, which consumes much electrical power, from beginning just after the start of timepiece movements and the charging of the power-supply and delays modulated driving to a time when the power-supply has been sufficiently charged so that modulated timepiece movements can be stably performed. As a result, it is possible to securely and reliably inform a user that timepiece movements have started after the timepiece-device display halted because of an inadequate power-supply, e.g., after a rechargeable battery was charged, without affecting continuation of timepiece movements.

According to the present invention, a structure in which modulated driving is performed only when the storage unit holds a termination-storage signal and the power-supply voltage reaches the first reference voltage has been employed. The structure prevents the situation in which the modulated driving is repeatedly performed when the power-supply voltage oscillates in the vicinity of the first reference voltage while timepiece movements of the timepiece device are being performed. The structure performs the modulated driving only when the timepiece device starts movements from a halt condition, and informs the user of that condition.

One embodiment of the invention includes a reference-signal generator for generating a reference signal when a voltage capable of driving the display-drive accumulates in the power-supply, and a termination-detector that outputs a termination-detection signal when the reference signal is not output from the reference-signal generator. According to the present invention, the reference signal is used to accurately detect whether or not timepiece movements are performed.

In one embodiment of the present invention, after the power-supply-voltage detection signal from the power-supply-voltage detector is input to the storage unit, the condition of the termination-storage signal is reset in accordance with predetermined conditions. The predetermined conditions preferably include, for example, the condition that the modulated driving starts or terminates. This prevents the situation in which the termination-storage signal is reset before the modulated driving starts. By resetting the termination-storage signal after a termination of the modulated driving, a timepiece device which securely and reliably performs modulated driving only after a start of timepiece movements from halt condition is realized. A more specific example of a predetermined condition is to reset the storage condition of the termination-storage signal by the storage unit when the power-supply-voltage detection signal is continuously input for a predetermined time from the power-supply-voltage detector.

In another embodiment of the present invention, the power-supply includes power-generator and power-storage member, and the power-storage member is charged by the power-generator. As a result, the charging can be easily performed.

In still another embodiment of the present invention, the display includes at least two pointers: a minute pointer and an hour pointer, and the modulated driving is performed with respect to at least one of the two pointers. In a timepiece device with an analog display, for example, a wrist watch which displays the time using two pointers, the movements of an hour pointer or a minute pointer are too slow to be recognized by eyes. Therefore, according to the present invention, by performing a modulated movement (different from normal movement) with respect to at least either the minute pointer or the hour pointer, a user can be securely and reliably informed that movements of the timepiece device and charging have started.

In a further embodiment of the present invention, the modulation-signal generator outputs the modulation signal after the power-supply-voltage detection signal from the power-supply-voltage detector has been continuously input to the modulation-signal generator for a predetermined time. For example, a charging voltage in the timepiece device does not always increase with charging. In many cases it increases as a whole while fluctuating irregularly. In addition, depending on the type of rechargeable battery used, there is a superficial charging voltage that differs from the real charging voltage. In such a case the superficial charging voltage may not directly reflect the actual charge in the power-supply. In this case, the present invention provides a structure in which the modulated driving is performed on condition that the power-supply voltage exceeds the first reference voltage for a predetermined time. Thus, the modulated driving can be performed without being affected by an irregular increase in the charging voltage.

In a still further embodiment of the present invention, the modulation-signal generator terminates outputting the modulation signal after a lapse of a predetermined time if the power-supply voltage is equal to or less than a second reference voltage that has been detected by the power-supply-voltage detector. This structure causes the modulated driving to be continuously performed for at least the predetermined time or longer, which more securely and reliably informs the user of the start of timepiece movements from a halt. Preferably, the predetermined time is set to the minimum necessary time for notifying the user of the modulated driving, for example, approximately 4 seconds. The second reference voltage may be set to an optional value as the need arises, and is preferably set to a voltage identical to the first reference voltage, or otherwise set to a voltage which is higher than the movement-start voltage and lower than the first reference voltage. As a result, modulated driving is continuously performed for an optimal time, and thus the user can be securely and reliably informed of a start of timepiece movement and timepiece-device charging, without hindering normal timepiece movements.

In still another embodiment of the present invention, the timepiece device includes display a control circuit for outputting a display-control signal for adjusting the time information displayed on the display so that the time is adjusted to the actual time. The display means frequently displays a time that is different than the actual time due to the modulated driving of the pointers. However, according to the present invention, it is possible that the display is automatically adjusted to display the accurate time information.

In a further embodiment, after the outputting of the modulation signal is terminated and modulated driving terminates, the display-control circuit outputs to the display-drive a reverse-driving signal for driving the pointers in a counterclockwise direction until the actual time is displayed.

In a still further embodiment the display-control circuit outputs to the display-drive a display-control signal for terminating the driving of the display until the displayed time that resulted from the modulated driving equals the time that would have been displayed had normal driving occurred.

In another embodiment of the present invention, a switching member for outputting a switching signal is included, and the modulation-signal generator terminates the output the modulation signal when the switching signal from the switching member is input to the modulation-signal generator. The switching member is preferably formed as a crown device which enables a timepiece-device user to optionally operate the pointers of display. When the timepiece-device user uses the crown device to adjust the displayed time, the modulation signal terminates. Thus, after the time adjustment by the crown device, normal timepiece movements can be performed so that the accurate time is displayed.

In another embodiment of the present invention, a timer is included for measuring the lapse of time during which the modulated-driving is performed and the modulation-signal generator terminates outputting the modulation signal after the lapse of a predetermined time during which the modulated driving was performed. The timer may be formed to be integrated with or to be independent of the modulation-signal generator.

In still another embodiment of the present invention, a driving-start control for controlling the display-drive is in a normal-driving-inhibited condition when the termination-storage signal is stored in the storage unit, is included. If a pointer-movement-start control is not provided, normal movements of pointers start immediately when the start of the charging of the power-supply causes the power-supply voltage to exceed the movement-start voltage, and power consumption thereof may cause the movements to be unstable. However, according to the present invention, by providing the pointer-movement-start control, normal movements of pointers can be inhibited to suppress power consumption until charging in the power-supply becomes sufficient, namely, until the modulated movements of pointers terminate. As a result, charging of the power-supply can be efficiently performed, and after charging starts, the timepiece device can be promptly placed in a condition in which stable movements of pointers are performed. In particular, normal driving initially starts in a phase in which the modulated movements of pointers terminate, which prevents the situation in which the modulated driving performed immediately after a start of normal driving. Accordingly, a timepiece device which better allows the user to sense restart after a halt condition can be obtained. The driving-start control may be formed to be integrated with or to be independent of the modulation-signal generator, if necessary.

In a further embodiment of the present invention, the display electronically displays the time. Therefore, the display means for the timepiece device can perform notification of the start of charging not only in an analog timepiece device but also in a digital timepiece device. Also, the display is not limited to a visual display, but may include, for example, one which uses an alarm, or its equivalent, for acoustic representation.

Accordingly, it is an object of the invention to provide a timepiece mechanism that performs modulated movements of pointers following a halt condition only if the timepiece device battery is sufficiently charged to perform the movements reliably and securely.

Another object of the invention is to provide a timepiece which does not prematurely indicate restart after a halting operation, therefore preventing drawing of the power supply resulting in another halt condition.

Still other objects and advantages of the invention will in part be obvious and will in part be apparent from the specification.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is made to the following description taken in connection with the accompanying drawings, in which.

DESCRIPTION OF THE PREFERRED EMBODIMENTS

Figure 1:
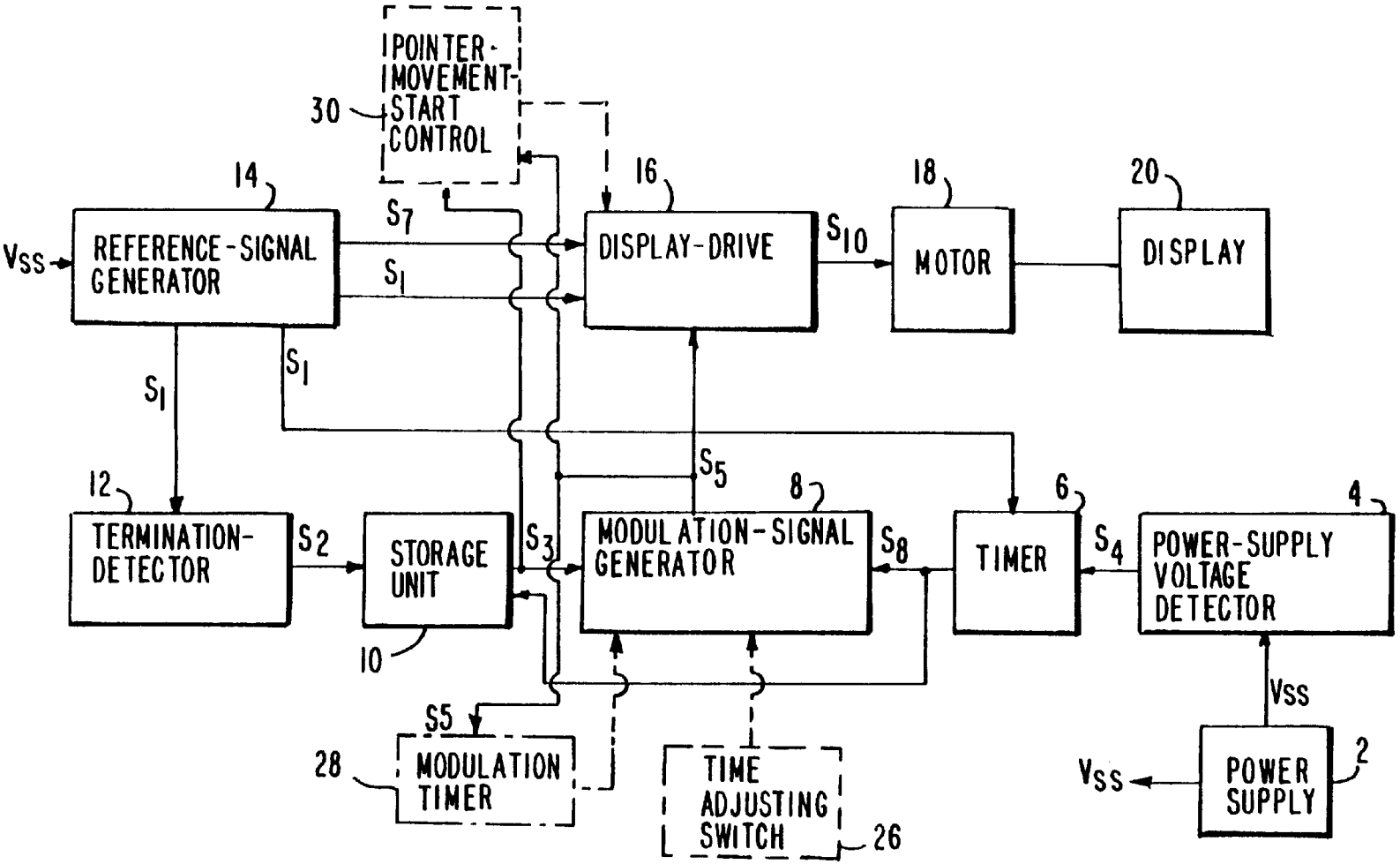
FIG. 1 is a block diagram showing a timepiece device in accordance with a first embodiment of the present invention.
Figure 2:
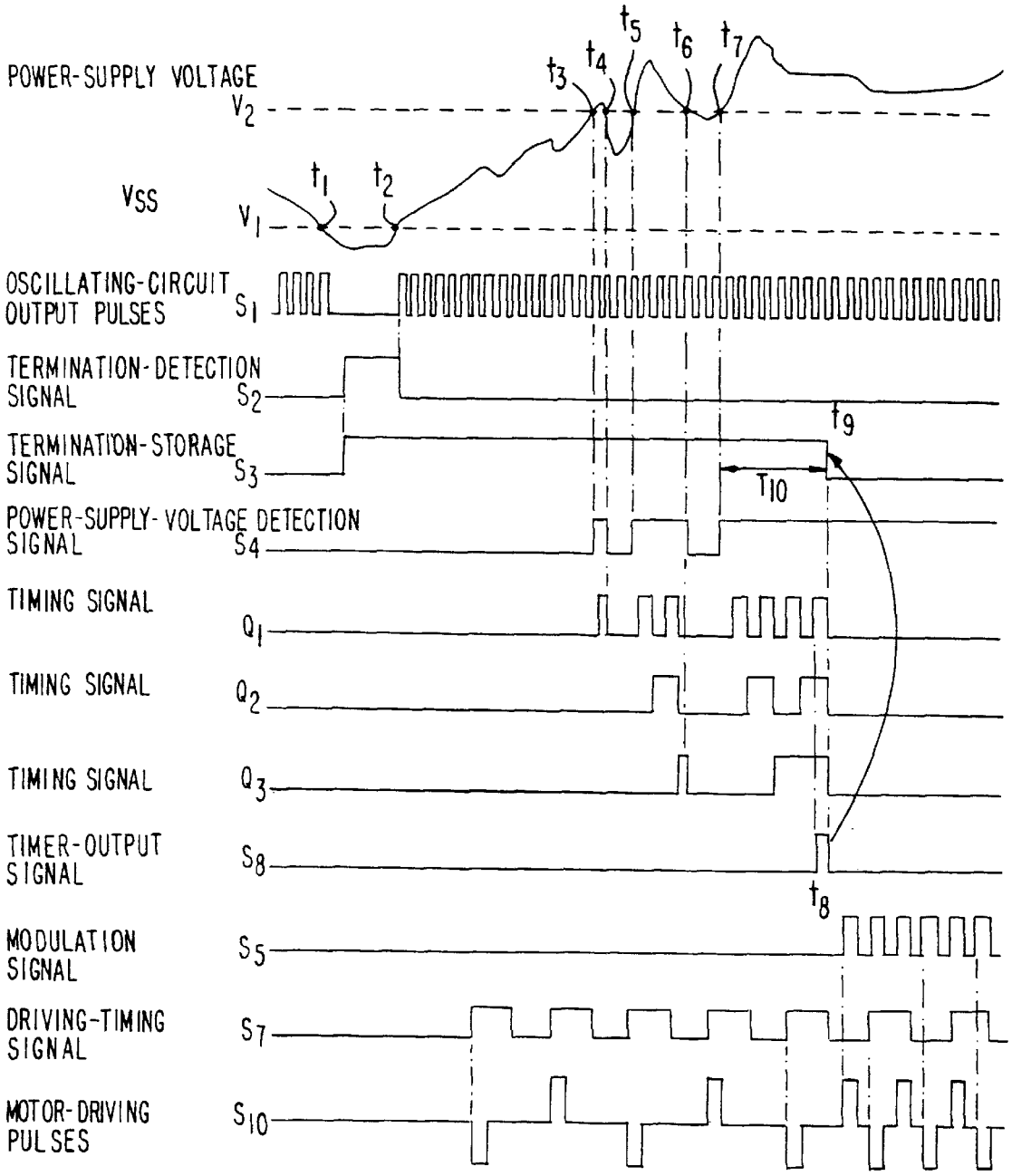
FIG. 2 is a timing chart showing operation of the timepiece device in accordance with the first embodiment of the invention.

Referring now to FIGS. 1–2, there is shown a block diagram of a timepiece device according to a first embodiment of the present invention, and a timing chart of signals in the timepiece device shown in FIG. 1.

The timepiece device contains a display 20 for displaying time information. For example, in an analog-type timepiece device, two pointers, an hour pointer and a minute pointer may be used to display the time and inform a user of the start of charging following a halt condition. Display 20 can also be constructed to operate in a digital-type timepiece device. Alternatively, display 20 is not limited to a visual display, but may include, for example one which uses an alarm for acoustic representation.

A power-supply 2 in the timepiece device includes a power-storage member that includes a rechargeable battery and a power-generator that charges the power-storage member. Thus, if the timepiece device is, for example, a wristwatch, the power generator may be motion activated so that the natural movement of the wristwatch causes the power-generator to generate electrical power which charges the power-storage member. A power-supply voltage accumulated in the power-supply 2 is input to a reference-signal generator 14.

Reference-signal generator 14 is coupled to power supply 2 and monitors the voltage level. Reference signal generator 14 provides outputs to a display drive 16, a timer 6 and a termination detector 12. Reference signal generator 14 may include, for example, an oscillator that generates oscillation-circuit-output pulses S1. Oscillation-circuit-output pulses S1 are reference pulses used when the timepiece device is driven, and are input to termination-detector 12, timer 6 and display-drive means 16. Reference-signal generator 14 also generates a driving timing signal S7 having a predetermined interval derived from oscillation-circuit-output pulses S1 and outputs it to display-drive 16.

Display-drive 16 also receives inputs from a modulation signal generator 8. Display drive 16 generates motor-driving pulses S10 for the normal movements of the pointers based on input oscillation-circuit-output pulses S1 and driving timing signal S7. Display-drive 16 generates motor-driving pulses S10 for modulated movements of pointers based on modulation signal S5 output by modulation signal generator 8. Motor-driving pulses S10 are output to and drive a motor 18.

Display 20 is connected to motor 18. The pointers of display 20 are driven by motor 18 in a manner that represents the time.

When the rechargeable battery of power-supply 2 is sufficiently charged, the pointers of display 20 are driven at normal velocity and thus, the normal movement of pointers are performed. When the timepiece device is not moved, power-supply 2 is not charged. However, because the normal movement of pointers by display 20 still continues, the charge contained in power-supply 2 is continuously drained to the point that reference-signal generator 14 terminates oscillation-circuit-output pulses S1 and driving-timing signal S7. As a result, normal movement of pointers cease, resulting in a halt condition. In a halt condition, power-supply voltage Vss from power-supply 2 is less than or equal to movement-start voltage V1.

Termination-detector 12 detects when oscillation-circuit-output pulses S1 have terminated and outputs a termination-detection signal S2 to a storage unit 10. Storage unit 10 holds inputted termination-detection signal S2 and outputs a termination-storage signal S3 to modulation-signal generator 8.

If the timepiece device, previously in a halt condition, is then moved or shaked to increase power-supply voltage Vss to movement-start voltage V1 or greater, the timepiece device resumes normal movements of pointers.

However, modulated movements of pointers is not performed until power-supply 2 has been charged to first reference voltage V2 that is higher than movement-start voltage V1. First reference voltage V2 is set to a value higher than movement-start voltage V1 so that power-supply voltage Vss will not drop below movement-start voltage V1 even though there is a temporary increase in power consumption due to the start of the modulated movements of pointers. As a result, it is possible to use modulated movements of pointers to inform a user that timepiece movements have started following a halt condition and to continue the timepiece movement securely and reliably.

Operation of the timepiece device mechanism is as follows:

Reference-signal generator 14 outputs oscillation-circuit-output pulses S1 and driving-timing signal S7 only when power-supply voltage Vss from power-supply 2 is greater than or equal to movement-start voltage V1. If, however, power-supply voltage Vss from power-supply 2 is less than movement-start voltage V1, such as between points t1 and t2 in FIG. 2, reference-signal generator 14 no longer generates oscillation-circuit-output pulses S1 and the timepiece device is in a halt condition. If power-supply voltage Vss again reaches movement-start voltage V1 or greater, such as after point t2, reference-signal generator 14 restarts outputting oscillation-circuit-output pulses S1 and driving-timing signal S7.

Termination-detector 12 detects when the output of oscillation-circuit-output pulses S1 is terminated, such as between t1 and t2, and outputs a termination-detection signal S2 to storage unit 10. Storage unit 10 holds input termination-detection signal S2, and outputs a termination-storage signal S3 to modulation-signal generator 8.

Power-supply voltage detector 4 detects whether power-supply voltage Vss from power-supply 2 is equal to or greater than first reference voltage V2 and outputs a power-supply-voltage detection signal S4 to timer 6 if power-supply voltage Vss has reached or exceeded first reference voltage V2.

Timer 6 detects the duration of power-supply-voltage detection signal S4, i.e., the duration of time during which power-supply voltage Vss is greater than or equal to first reference voltage V2. If it has detected that the duration of power-supply-voltage detection signal S4 was at least equal to a predetermined time, timer 6 outputs a timer-output signal S8 to modulation-signal generator 8 and storage unit 10.

In the preferred embodiment, timer 6 includes a flip-flop which measures the duration of power-supply-voltage detection signal S4. For example, between points t3 and t4 and between points t5 and t6, power-supply voltage Vss is greater than or equal to first reference voltage V2, which causes power-supply-voltage detector 4 to output power-supply-voltage detection signal S4. Power-supply-voltage detection signal S4 is input into the flip-flop contained in timer 6. The flip-flop is designed so that timing signals Q1, Q2 and Q3 generated by it can be used to determine whether power-supply-voltage detection signals S4 is input to timer means 6 for predetermined time T10. In particular, the falling edges of output pulses of the timing signals Q1, Q2 and Q3 coincide when the power-supply-voltage detection signal S4 has been continuously input to timer 6 for predetermined time T10.

As shown in FIG. 2, the time intervals t3 to t4 and t5 to t6 are shorter than the predetermined time, and thus, timer-output signal S8 is not output to modulation-signal generator 8. However, after point t7, power-supply-voltage detection signal S4 is continuously input to timer 6 which causes the falling edges of output pulses of timing signals Q1, Q2 and Q3 to coincide at t8 to detect that predetermined time T10 has lapsed. Also at point t8, timer 6 outputs timer-output signal S8 to modulation-signal generator 8 and storage unit 10.

In the preferred embodiment, storage unit 10 resets at a point t9, which coincides with the falling-edge of timer-output signal S8, causing termination-storage signal S3 to be terminated. However, other predetermined conditions may be used to reset termination-storage signal S3, such as the condition that modulated driving starts or terminates. This prevents the resetting of termination storage signal S3 before modulated driving begins.

Modulation-signal generator 8 generates a modulation signal S5 when timer-output signal S8 from timer 6 is input thereto at the same time termination-storage signal S3 from storage unit 10 is being input thereto.

Thus, modulated driving is performed only when the storage unit 10 holds termination-storage signal S3 and power-supply voltage Vss reaches first reference voltage V2. This prevents the situation where modulated driving is repeatedly performed when power-supply voltage Vss oscillates in the vicinity of first reference voltage V2 while timepiece movements of the timepiece device are being performed. The structure therefore performs the modulated driving only when the timepiece device starts movements from a halt condition. Modulation signal S5 is output to display-drive 16.

When modulation signal S5 is not input to display-drive 16, display-drive 16 generates motor-driving pulses S10 for driving motor 18, based on the driving-timing signal S7 input from reference-signal generator 14, which in turn causes display 20 to display the time by normal movements of pointers. However, when modulation signal S5 is input, display-drive 16 generates modulated motor-driving pulses S10 for driving motor 18, which in turn causes display 20 to perform modulated movements of pointers.

In summary, in the preferred embodiment, after a halt condition display-drive 16 outputs motor-driving pulses S10 for normal movements of pointers synchronized with driving-timing signal S7 when power-supply voltage Vss is greater than or equal to the movement-start voltage V1 but is not greater than first reference voltage V2 for predetermined time duration T10. Display-drive 16 outputs motor-driving pulses S10 for modulated movements of pointers synchronized with the modulation signal S5 when power supply voltage Vss is greater than or equal to first reference voltage V2 for predetermined time duration T10. Motor 18 thus drives display 20 in accordance with these changes in motor-driving pulses S10.

Figure 3:
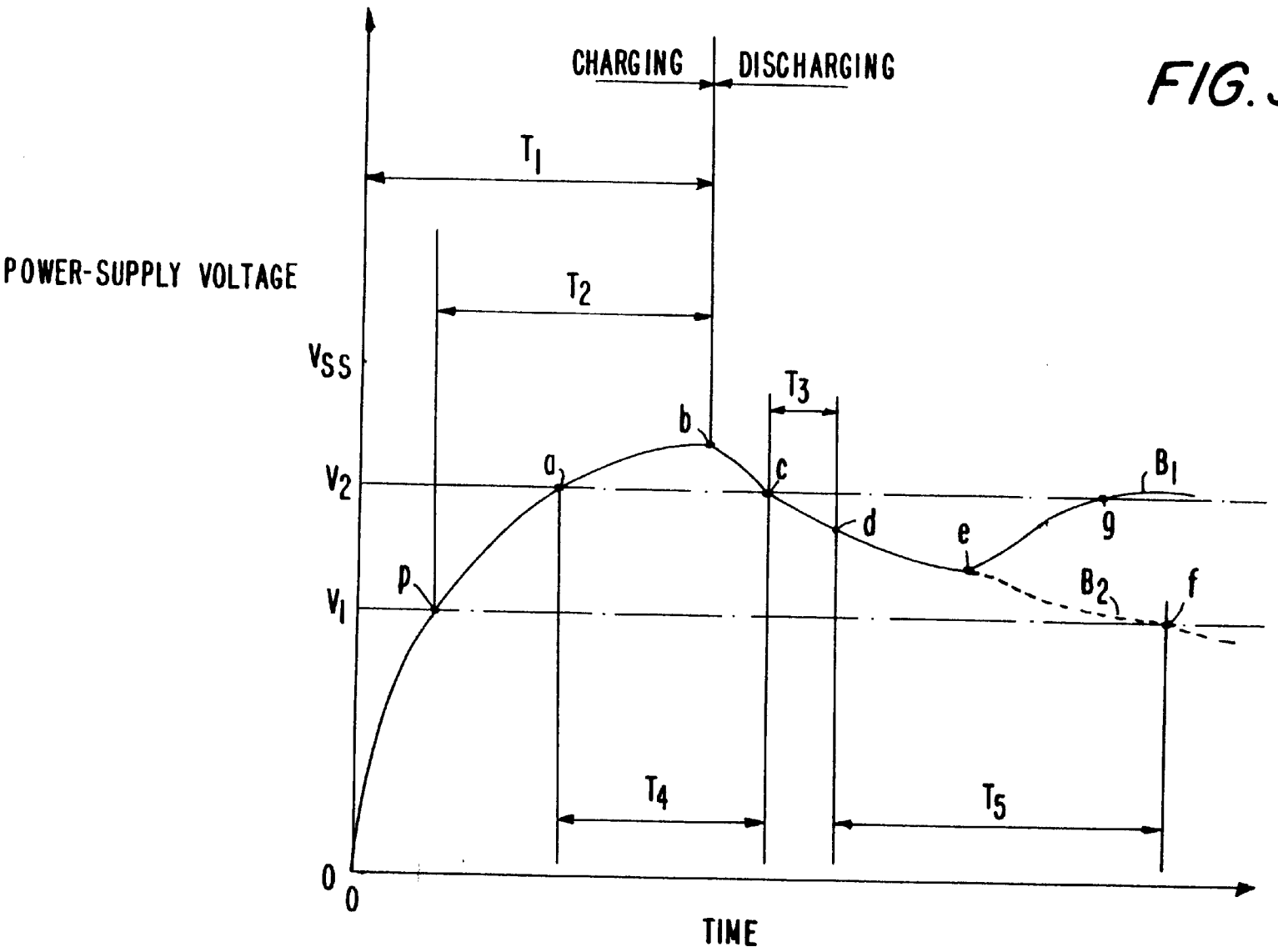
FIG. 3 is a voltage graph illustrating an example of charging and discharging in a timepiece device.

Referring now to FIG. 3, there is shown a graph of power-supply voltage Vss accumulated in power-supply 2 of the timepiece device as a function of time. FIG. 3 shows changes in power-supply voltage Vss after the charging of power-supply 2 has resumed after a halt condition; i.e. power supply voltage Vss fell below movement-start voltage V1.

By shaking or moving the timepiece device, power-supply 2 starts charging, and power-supply voltage Vss reaches movement-start voltage V1 at point p, which restarts normal movement of pointers. After that time, further moving of the timepiece device will cause power-supply voltage Vss to reach first reference voltage V2 at point a. First reference voltage V2 is, for example, 1.0 V. At point a, when power-supply voltage Vss continues to be equal to or greater than first reference voltage V2 for a predetermined time, modulation signal S5 is output from modulation-signal generator 8, which causes display-drive 16 to output motor-driving pulses S10 for modulated movements of pointers. Thus, modulated movement of pointers is started.

As described above, if the modulated movements of pointers are started just after power-supply voltage Vss reaches point p but does not exceed first reference voltage V2 for predetermined time T10, then the higher power consumption due to the modulated movements of pointers may cause power-supply voltage Vss to decrease below the movement-start voltage V1 thereby terminating the modulated movements of pointers. Accordingly, in the preferred embodiment the modulated movements of pointers are initiated only after power-supply voltage Vss has reached first reference voltage V2 for predetermined time T10, thereby ensuring that stable and reliable modulated movements of pointers can be performed.

The timepiece device in FIG. 1 employs a structure for performing modulated movements of pointers by determining whether or not the power-supply voltage Vss is greater to or equal to first reference voltage V2 for a predetermined time, thereby reducing effects of changes in the power-supply voltage Vss during charging. However, depending on which type of power-supply 2 is used, there may be less fluctuation in power-supply voltage Vss during charging. In such a case, the modulated movements of the pointers may be started when the power-supply voltage Vss has reached the first reference voltage V2 without the need to have power-supply voltage Vss be greater than first reference voltage V2 for a predetermined time.

If the timepiece device is continuously moved, power-supply 2 is continuously charged, and power-supply voltage Vss continues to increase to point b. Time T1 is the time it takes for power-supply voltage Vss to charge from 0v to point b, while time T2 is the time it takes for power-supply voltage Vss to charge from movement-start voltage V1 to point b. If after power-supply voltage Vss reaches point b the timepiece device is no longer moved or shaked, charging of power-supply 2 ceases.

In the preferred embodiment, the timepiece device terminates the modulated movement of pointers and restarts the normal movement of pointers when power-supply voltage Vss from power-supply 2 becomes less than or equal to first reference voltage V2. When this occurs, power-supply-voltage detector 4 outputs to timer 6 power-supply-voltage detection signal S4 indicating that power-supply voltage Vss has discharged to first reference voltage V2 or below. When the power-supply-voltage detection signal S4 is output to timer 6 for a predetermined time T3, timer 6 outputs to modulation-signal generator 8 timer-output signal S8 commanding a termination of the modulated movements of pointers. Thereafter, modulation-signal generator 8 no longer outputs modulation signal S5 to display drive 16 and the modulated movements of pointers terminate.

As described above, according to this embodiment, modulated movements of pointers are discontinued and normal movements of pointers are restarted at point d which occurs after power-supply voltage Vss from power-supply 2 discharges to first reference voltage V2 or below for a predetermined time T3. Therefore, even if the modulated movement of pointers performed during interval T4 is not long enough to alert the user that the timepiece device has been restarted from a halt condition, the modulated movement of pointers are still performed during time T3, which gives the user additional time to become aware of the modulated movements of pointers. Time T3 may be optionally determined in accordance with the type of timepiece device and its use in some circumstances. T3 may be set to 0. In this embodiment, T3 is set to approximately 4 seconds.

Alternatively, a second reference voltage can be used to determine whether modulated movements should be discontinued. This second reference voltage, can be set to be equal to first reference voltage V2. However, the second reference voltage may be set to an optional value if necessary. In order to obtain a sufficient modulated driving time which is sufficient to reliably inform the user of the restart condition without hindering normal timepiece movements, it is preferable to set the second reference voltage to a value which is greater than or equal to movement-start voltage V1 and less than or equal to first reference voltage V2.

After point d, at which time normal movements of pointers are resumed, the charging of power-supply 2 is a result of the timepiece device being moved or shaken at point e and results in curve $B_1$. In this case, power-supply voltage Vss exceeds the first reference voltage V2 again at point g, which causes termination-storage signal S3 stored in storage unit 10 to be reset as described above, modulation signal S5 is not outputted, and normal movements of pointers is continued.

In addition, when charging of power supply 2 in the timepiece device does not occur when power-supply voltage Vss is at point d, during which time normal movements of points are performed, power-supply voltage Vss will further decrease as shown by dotted-line curve $B_2$, power-supply voltage Vss will then drop to movement-start voltage V1 at point f, at which time the normal movement of pointers will cease. Therefore, during the time period T5 between points d and f, the normal movement of pointers is performed, but will cease if power-supply voltage Vss falls below movement start voltage V1.

Alternatively, the modulated movement of pointers may be terminated when the user adjusts the time of the timepiece device. The timepiece device also includes a time adjusting switch 26 shown (in dotted lines in FIG. 1) for adjusting time information displayed on display 20. The switch may be, for example, a so-called crown device. In the timepiece device, when the operation of the switch has been detected, modulation-signal generator 8 receives a signal from time adjustment switch 28 and terminates outputting modulation signal S5. Subsequently, motor-driving pulses S10 synchronized with driving-timing signal S7 are outputted from display drive 16, and switching to the normal movement of pointers occurs. This enables automatic switching from the modulated movements to the normal movements of pointers when the user adjusts the time during the modulated movements of pointers in the timepiece device.

In another alternative embodiment, modulated movement of pointers would terminate after a lapse of a predetermined time. Specifically, the modulation signal from modulation signal generator 8 can be applied to a modulation timer 28 (shown in chain lines in FIG. 1) which cuts off modulation generator 8 after a predetermined time.

Figure 4:
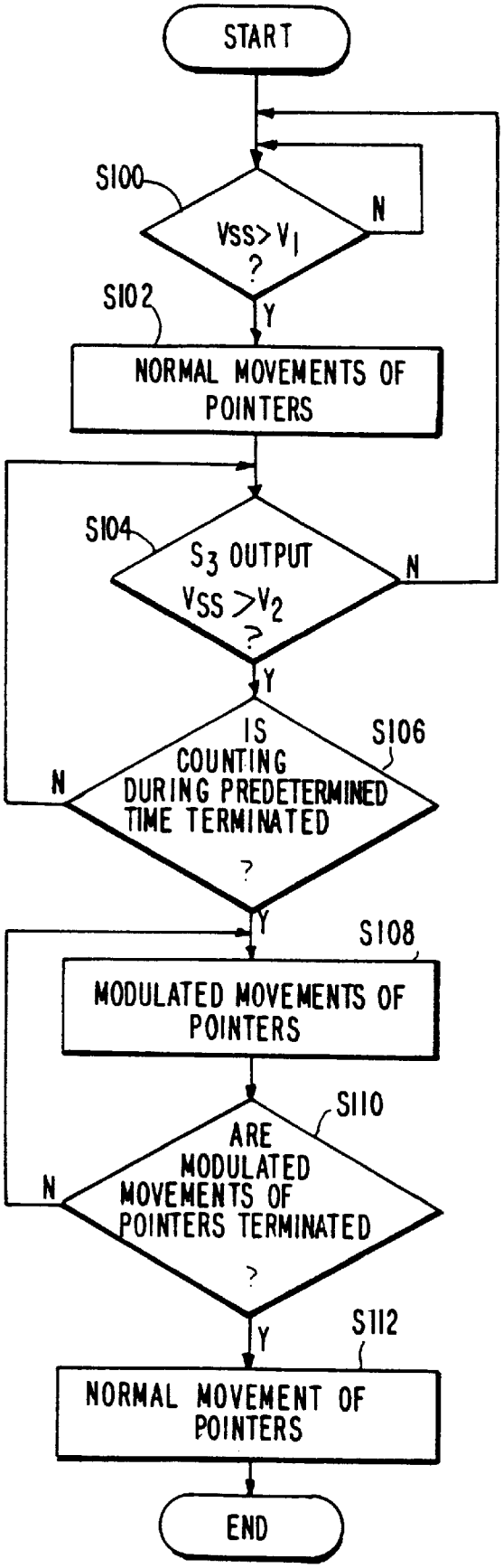
FIG. 4 is a flowchart illustrating operation of the timepiece device in accordance with the first embodiment of the invention.

Referring now to FIG. 4, there is shown a flowchart illustrating the changes made to the movement of pointers by display 20 in the timepiece device.

In step S100 of the flowchart, power-supply voltage Vss is detected. If power-supply voltage Vss is higher than movement-start voltage V1, the flowchart proceeds to step S102, in which the normal movement of pointers is performed using motor-driving pulses S10 synchronized with the driving-timing signal S7. In step S104, it is determined whether termination-detection signal S3 is stored in storage unit 10. If it is and power-supply voltage Vss is greater than first reference voltage V2, the flowchart proceeds to step S106 and counting is performed by timer 6. Timer 6 performs counting only while power-supply-voltage detection signal S4 is being input. If timer 6 counting terminates before predetermined time T10 elapsed, step S104 is repeated. If timer 6 counting is completed, motor-driving pulses S10 synchronized with modulation signal S5 output from modulation-signal generator 8 are used to perform the modulated movements of pointers.

In step S110, it is determined whether power-supply voltage Vss is less than or equal to first reference voltage V2 for predetermined time T3. If that occurs, the modulated movement of pointers is terminated and the flowchart proceeds to step S112 where the normal movement of pointers is restarted.

When the normal movement of pointers is restarted, the time information displayed on display 20 differs from the actual time because of the increased velocity of the pointers during modulated movements of pointers. Particularly, when the user has adjusted the displayed time to the actual time during normal movements of pointers between points p and a shown in FIG. 3, the modulated movements of pointers which occurs between points a and d causes the displayed time to be different than the actual time thus requiring the user to readjust the displayed time after the modulated movement of pointers terminates.

Figure 5:
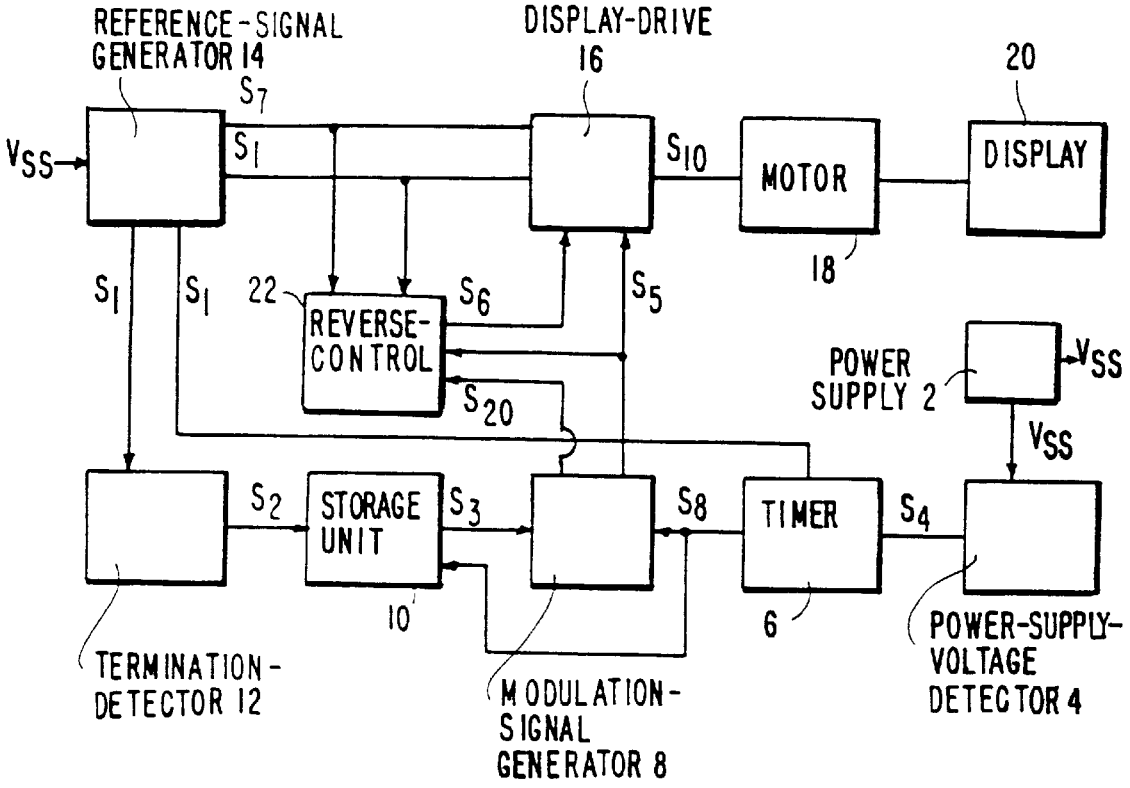
FIG. 5 is a block diagram of a timepiece device constructed in accordance with the second embodiment of the invention.

Referring now to FIG. 5, there is shown a block diagram of a timepiece device according to the second embodiment in which the above-described inconveniences are eliminated. Like elements from the first embodiment of FIG. 1 are identified by like numbers. The primary difference between the embodiments is inclusion of a reversal control for adjusting the display. Accordingly, detailed descriptions of the blocks will be omitted.

The timepiece device is designed such that the user uses a time-adjustment member such as a winder-knob (not shown) to adjust the displayed time to the actual time when normal movements of pointers are performed between points p and a shown in FIG. 3, the modulated movements of pointers between points b and d causes the displayed time to be different than the actual time. After modulated movements of pointers terminate at point d, it is desired that the timepiece device automatically adjust the time displayed on display 20. Accordingly, the timepiece device shown in FIG. 5 is formed by adding to the structure of the timepiece device shown in FIG. 1, reverse-control 22 as one embodiment of a display-control.

Reverse-control 22 receives signals S1, S7 from reference signal generator 14 as inputs. Reverse-control 22 also receives signals S5 and S20 as inputs from modulation signal generator 8 and outputs a signal S6 to display drive 16. While modulation-signal generator 8 outputs modulation signal S5, reverse-control 22 determines the difference between the time displayed on display 20 and the actual time based on the time the user has previously set. After the modulated movement of pointers terminates, reverse-control 22 outputs a reverse-driving signal S6 to display-drive means 16 so that the time displayed on display 20 can be adjusted to the actual time. The reverse-driving signal S6 causes display-drive 16 to output motor-driving pulses S10 for driving motor 18 in reverse, which moves the hour pointer and minute pointer in display 20 in a counterclockwise direction to display the actual time.

Figure 6:
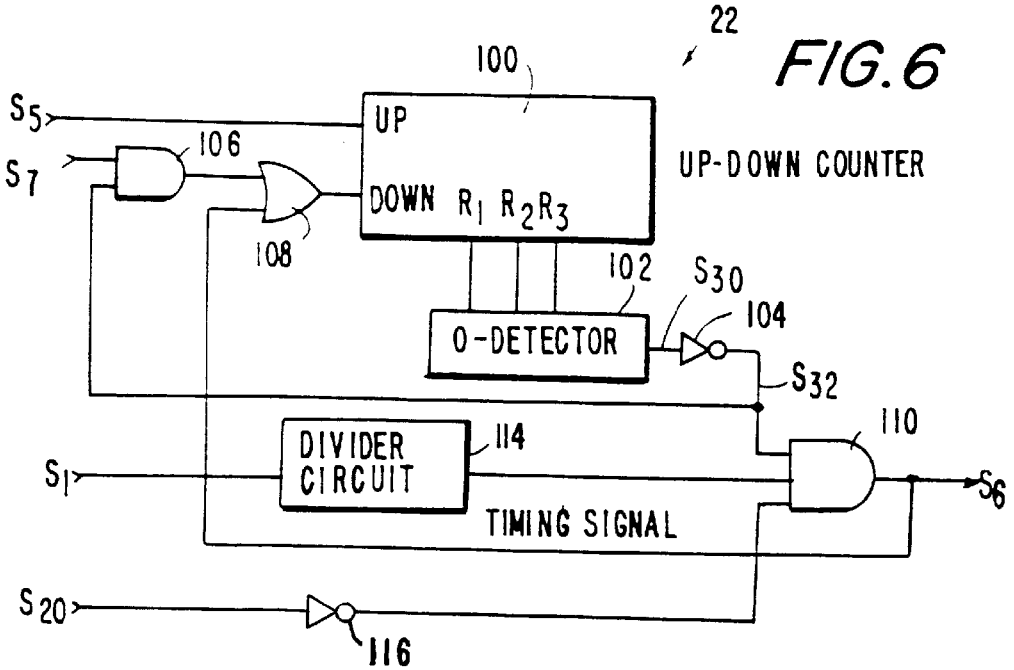
FIG. 6 is a block diagram of a reverse-control circuit constructed in accordance with the second embodiment of the invention.
Figure 7:
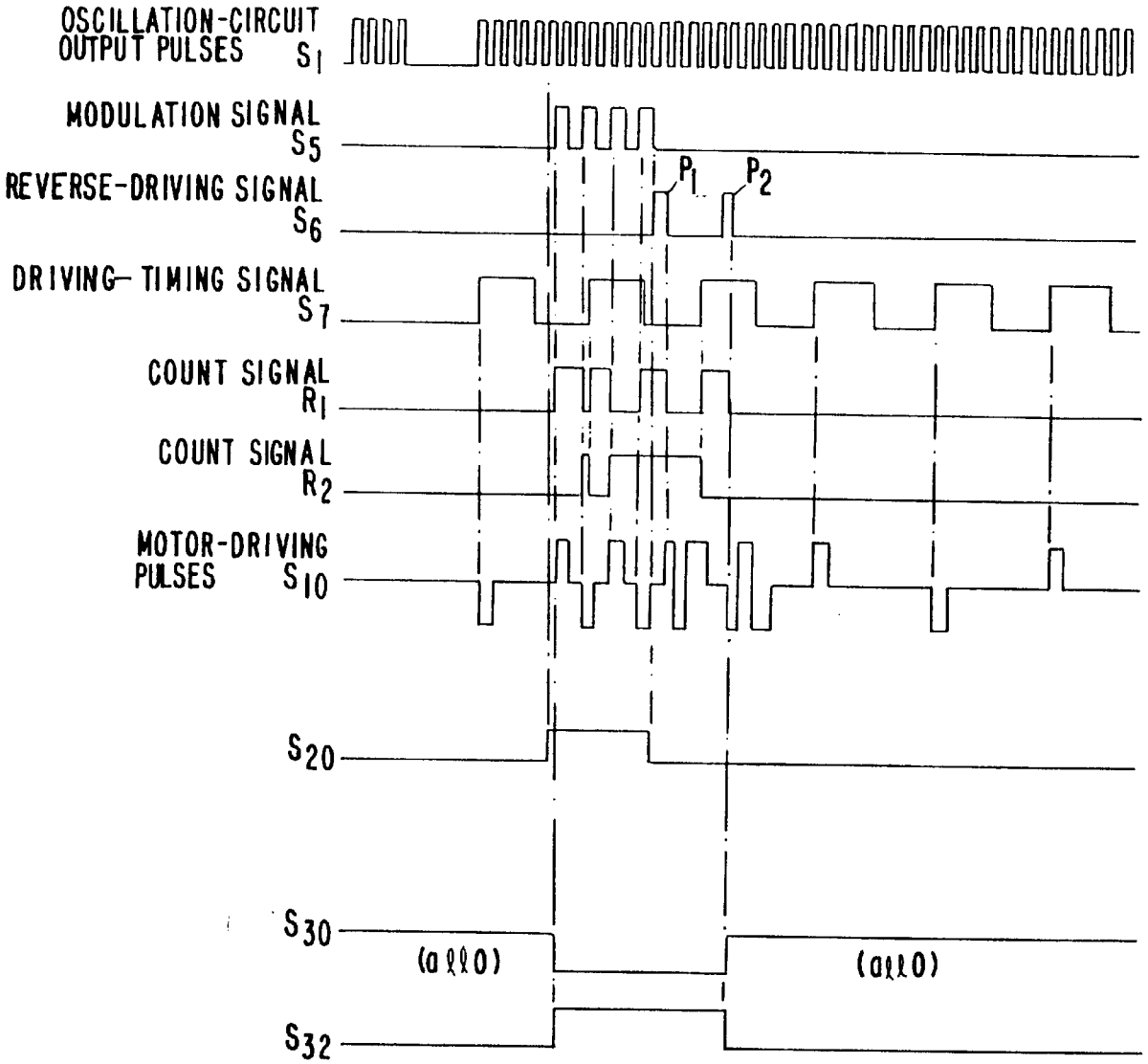
FIG. 7 is a timing chart showing signals in the timepiece device in accordance with the second invention of the invention.

Reference is now made to FIGS. 6 and 7 in which a block diagram of reverse-driving control 22, and associated timing chart, are provided. Reverse control 22, according to this embodiment includes an up-down counter 100 for receiving signal S5 as the input signal for counting up the pulses of the modulation signal S5. An AND gate 106 receives signal S7 as a first input and signal S32 output by a 0-detector 102 as a second input. An OR gate 108 receives the output of AND gate 106 as a first input and signal S6 as a second input and provides an output to the down input of up-down counter 100 for counting down the pulses inputted from OR gate 108. 0-detector 102 detects the R1, R2, R3 outputs of up-down counter 108 and determines whether or not the count outputs of the up-down counter 100 are all zeros, and outputs a high voltage level signal S30 only when the outputs are all zeros. A op amp 104 outputs a signal S32 formed by inverting signal S30 output by 0-detector 102; AND gate 106 inputs driving-timing signal S7 to OR gate 108 when gate signal S32 is at a high voltage level. A divider circuit 114 receives S1 and outputs a timing signal. An AND gate 110 receives the timing signals signal S32 and signal S20 as inputs and produces signal S6.

The up-down counter 100 counts the number of pulses of modulation signal S5 outputted from modulation-signal generator 8. When up-down counter 100 starts counting, outputs R1, R2, R3 of the up-down counter 100 have values different from zero. When outputs R1, R2, R3 are different than zero, 0-detector 102 detects this condition and outputs low-level voltage signal S30. Gate 104 inverts signal S30 and outputs high-level voltage signal S32 to AND gate 110 and AND gate 106.

At the same time, AND gate 106 inputs to the down-count terminal of up-down counter 100 via OR gate 108 in response to driving-timing signal S7 outputted from reference-signal generator 14. This causes up-down counter 100 to count down the number of pulses of driving-timing signal S7 inputted from the start of the modulated movement of the pointers. The difference between the pulse counts of modulation signal S5 and driving-timing signal S7 is equal to the time difference between the displayed time and the actual time. This time difference is contained on outputs R1, R2, R3. Consequently, 0-detector 102 outputs high-level voltage signal S32 to AND gates 110 and 106 via the gate 104 until the count outputs of up-down counter 100, i.e., the time difference between the displayed and actual time, becomes zero.

In addition, as shown in FIG. 7, modulation-signal generator 8 outputs a high-level voltage signal S20 during a modulated-driving period during which the modulation signal S5 is output and modulation signal generator 8 inputs high voltage level signal S20 to AND gate 110 via an inverter 116.

Reverse control 22 includes a divider circuit 114 which generates a timing signal having a predetermined cycle for reverse driving by dividing output pulses S1 outputted from reference-signal generator 14 and inputting the timing signal to AND gate 110. Thereby, in a period during which high-voltage level signal S20, representing the modulated-driving period, is not inputted to AND gate 110 through inverter 116, and the high-voltage level signal S32, indicating that the count outputs of the up-down counter 100 are values different from zero, is inputted to AND gate 110, the timing signal output from divider circuit 114 is outputted as the pulse signal of reverse-driving signal S6 to the display-drive 16. Simultaneously, the pulses of reverse-driving signal S6 output from AND gate 110 are input to down-count terminal of up-down counter 100 via the OR gate 108.

Because time also passed during the period in which reverse-driving signal S6 is outputted, driving-timing signal S7 is input to the down-count terminal of the up-down counter 100. Thus, the lapse of time during the reverse-driving period is also accounted for in reverse-driving signal S6 that is outputted to display-drive 16.

In the above manner, reverse-driving signal S6 is output from the reverse-drive 22 so that the actual time, which would have been displayed by display 20 if it were not for the modulated movement of the pointers, is displayed.

Figure 8:
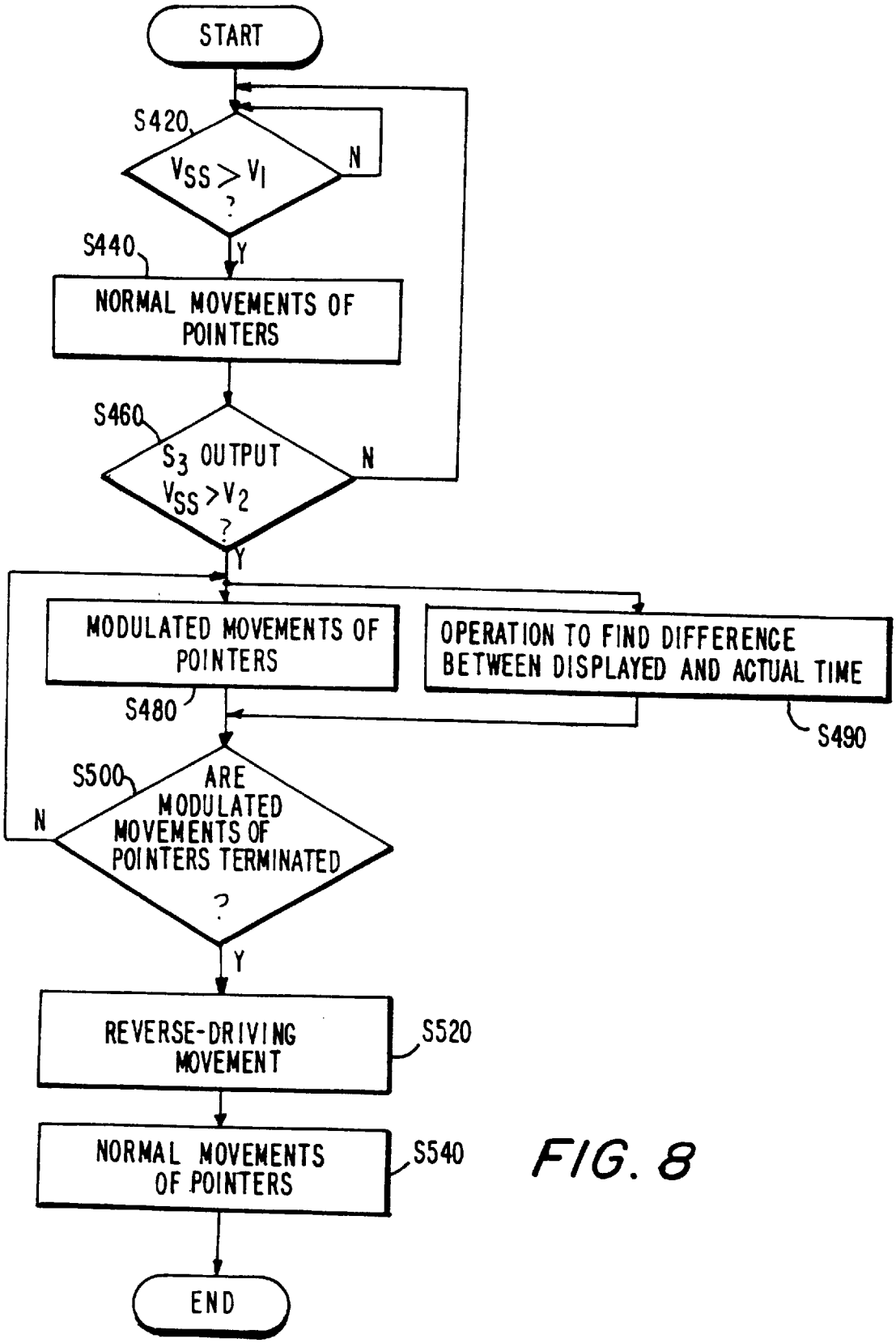
FIG. 8 is a flowchart illustrating operation of pointers in accordance with the second embodiment of the invention.

Referring now to FIG. 8, there is shown a flowchart of the operation in accordance with this embodiment. Because the operations of steps S220 to S280, S300 and S340 are similar to those of steps S100 to S106, S108, S110 and S112 in FIG. 4, descriptions thereof will be omitted.

According to this embodiment, when modulated movements of pointers start in step S280, reverse-control means 22 simultaneously carries out an operation to find the time difference between the displayed time and the actual time in step S290. After a termination of the modulated movements of pointers in step S300, in step S320, display 20 is reversely driven to display the actual time based on the time difference obtained by the operation in step S290. Subsequently, in step S340, normal movement of the pointers is restarted.

Figure 9:
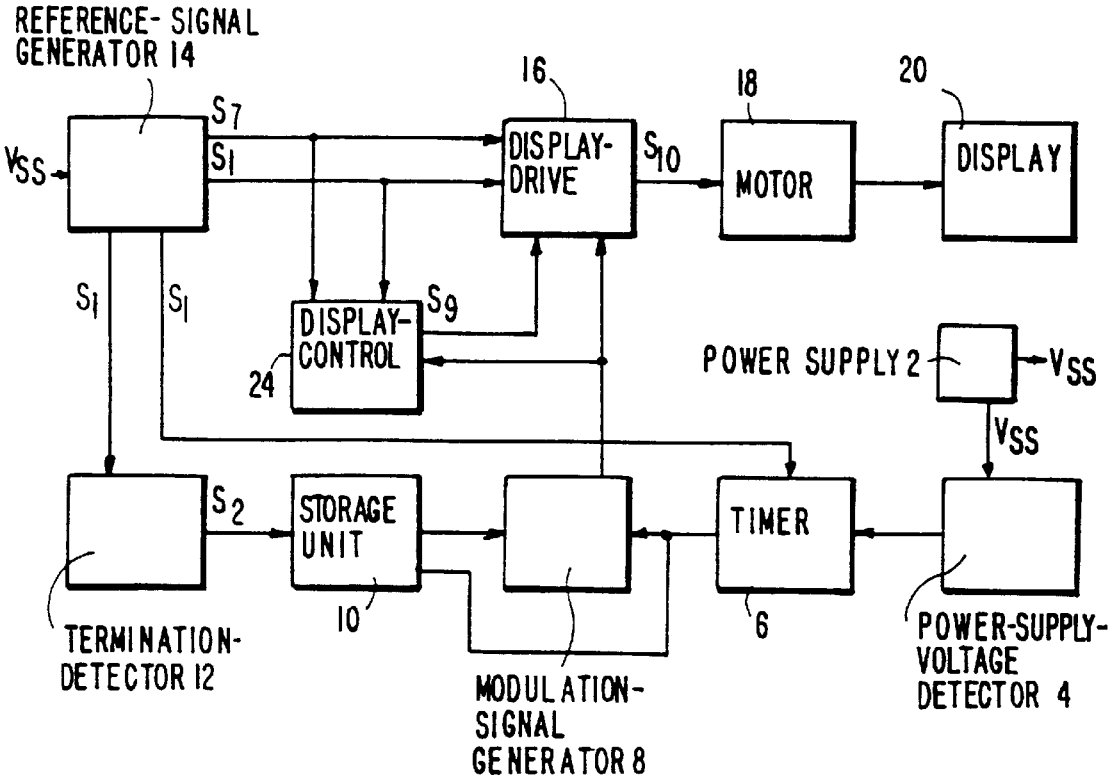
FIG. 9 is a block diagram of a timepiece device according to a third embodiment of the invention.

Referring now to FIGS. 9–12, wherein a block diagram of a timepiece device and operation thereof in accordance with a third embodiment are shown. The third embodiment of the invention is similar to the second embodiment of the invention, the primary difference being that the timepiece device according to the third embodiment, shown in FIG. 9, is provided with a display-control 24 instead of reverse-control 22. Like numerals are utilized to identify like structures.

Figure 10:
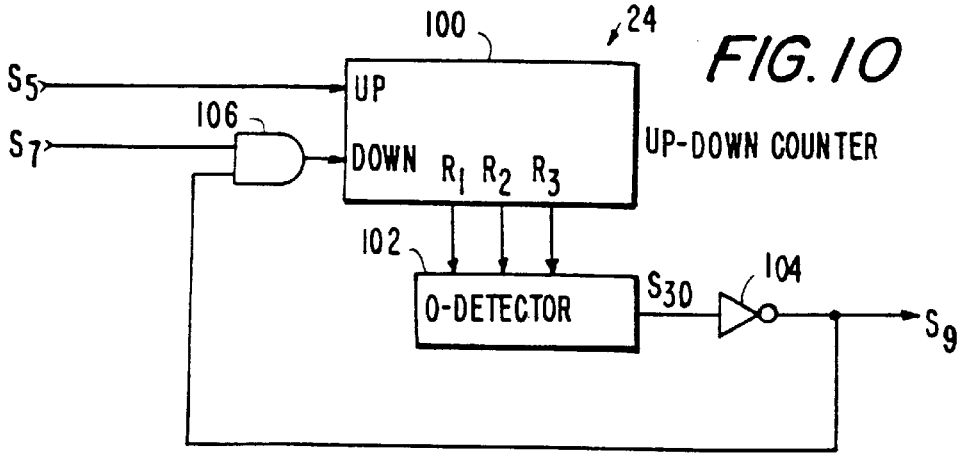
FIG. 10 is a block diagram of a display-control constructed in accordance with the third embodiment of the invention.

FIG. 10 shows a block diagram of display-control circuit 24. The structures of up-down counter 100, 0-detector 102, gate 104 and AND gate 106 which are included in display-control circuit 24 are similar to those of reverse-control 22 shown in FIG. 6, and descriptions thereof will be omitted. The differences are that a signal S9 is output by op amp 104 and modulation signal generator does not output a signal S20.

Figure 11:
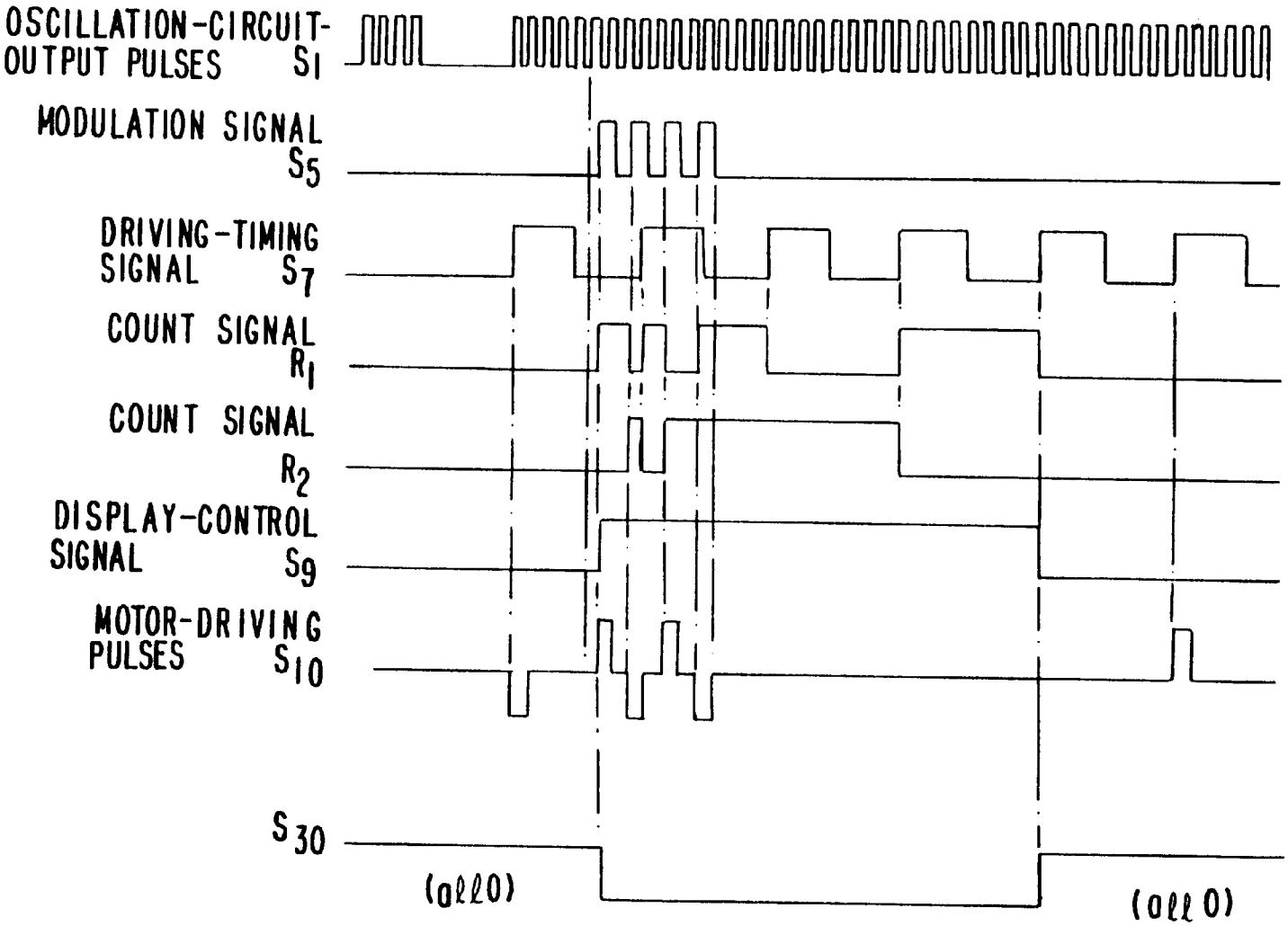
FIG. 11 is a timing chart showing signals in the timepiece device in accordance with the third embodiment of the invention.
Figure 12:
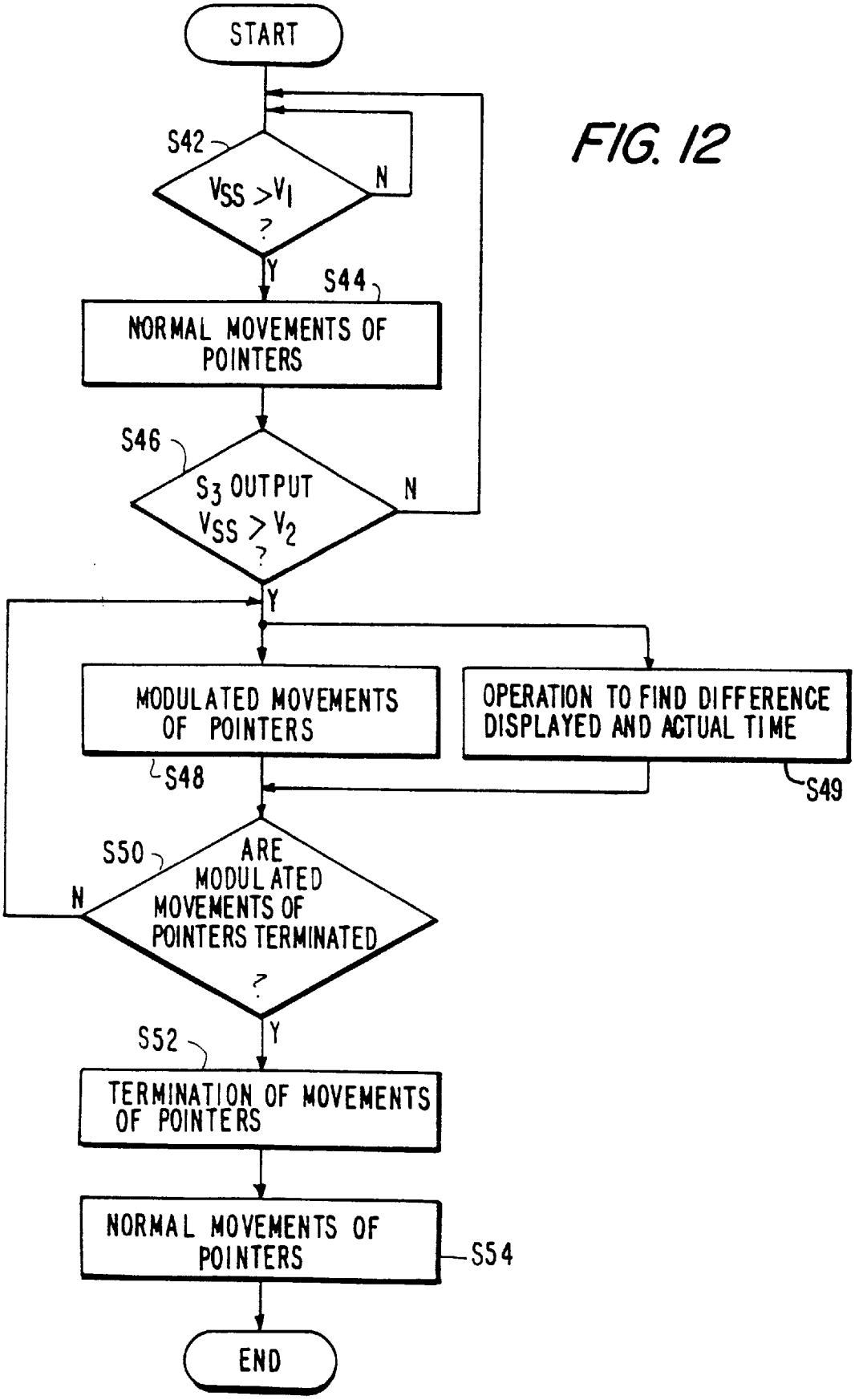
FIG. 12 is a flowchart illustrating operation of the timepiece device in accordance with a third embodiment of the invention.

FIG. 11 shows a timing chart for the timepiece device of FIG. 9 and FIG. 12 shows a flowchart of this embodiment, in which steps S420 to S500 and S540 correspond to steps S220 to S300 and S340 in the operation flowchart shown in FIG. 7, and descriptions thereof will be omitted.

In the timepiece device according to this embodiment, when modulated movement of pointers start in step S480, display-control circuit 24 carries out an operation to determine the time difference between the actual time and the displayed time which was caused by the advancement of the pointers during the modulated movements of pointers, as shown in step S490. The technique used to find this time difference is similar to the technique used by reverse-control 22 shown in FIG. 5, and a description thereof will be omitted.

When the modulated movement of pointers terminates in step S500, display-control 24 outputs to display-drive 16 a display-control signal S9 for terminating the movements of pointers, as shown in step S520. During the period in which display-control signal S9 is output, display-drive 16 does not receive driving-timing signal S7 outputted from reference-signal generator 14, thus causing the output of motor-driving pulses S10 to motor 18 to terminate. By terminating the driving of display 20 until the displayed time that resulted from the modulated driving equals the time that would have been displayed had normal driving occurred, display 20 is adjusted to actual time.

Display-control 24 uses up-down counter 100 to determine the difference between the time displayed on display 20, when the movements of pointers was halted in step S520 and the actual time. Display-control 24 determines this difference by counting the pulses of driving-timing signal S7 outputted from reference-signal generator 14 by finding the difference between the number of pulses of modulation signal S5 which caused modulated movements of pointers and the number of pulses of driving-timing signal S7 output from reference-signal generator 14 since the modulated movements of pointers has started. Display-control 24 outputs display-control signal S9 to display-drive 16 until this difference becomes zero, and terminates outputting the signal when the difference reaches zero. Display-drive 16 resumes outputting motor-driving pulses S10 based on the driving-timing signal S7 when display-control signal S9 is not input thereto. Thereby, normal movements of pointers is started in step S540, and the display of time on display 20 is restored.

The present invention is not limited to the foregoing embodiments, but may be variously modified for practice within the scope thereof. For example, according to the above-described embodiments, modulated movements of pointers are terminated by comparing a power-supply-voltage Vss and a first reference voltage V2. However, the present invention is not limited thereto and modulated movements of pointers may be terminated based on other conditions. For example, by providing timer 6 for counting a lapse of a time from a start of modulated movement of the pointers, the outputting of modulation signal S5 may also be terminated when timer 6 detects a lapse of a predetermined time. Also, a timer may be formed to be integrated with or to be independent of the modulation-signal generator 8.

If necessary, when termination-storage signal S3 is stored in storage unit 10, a timepiece device according to the present invention may include a pointer-movement-start control 30 (shown in FIG. 1) for controlling the display-drive 16 to be in a normal pointer-movement-inhibited condition until the modulated driving terminates. If pointer-movement-start control 30 is not provided, normal movement of the pointers start instantly when a start of charging in power-supply 2 causes a power-supply voltage to exceed movement-start voltage V1, and power consumption may cause the movement to be unstable. By providing pointer-movement-start control 30, normal pointer movement can be inhibited to suppress power consumption until charging in the power-supply becomes sufficient, i.e., until the modulated movements of pointers terminate. As a result, charging of power-supply 2 can be efficiently performed, and after the start of charging, movements of pointers can be performed in a stable and reliable manner.

In particular, normal driving initially starts when the modulated movements of the pointers terminate, which prevents the modulated driving from suddenly occurring just after a start of normal driving following a halt condition. Accordingly, a timepiece device which better allows the user to sense restart after a halt condition can be obtained. If necessary, pointer-movement-start control 30 may be formed to be integrated with or to be independent of the modulated-pointer-movement generator.

The above-described embodiments have described cases in which modulated driving is performed by modulated movements of analog display pointers. However, the present invention is not limited thereto, but may be designed such that similar modulated driving is performed in a digital display device. In this case the modulated driving may be designed to operate visually and/or acoustically.

It will thus be seen that the objects set forth above, and those made apparent from the preceding description, are efficiently attained and, because certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

We claim:

1. A timepiece device comprising:

a display, said display displaying time information;

a display-drive coupled to said display, said display-drive driving said display;

a termination-detector coupled to said display, said termination-detector monitoring said display and outputting a termination-detection signal when detecting a halt of said display;

a storage unit receiving and holding said termination detection signal and outputting a termination-storage signal in response thereto;

a power supply outputting a voltage;

a power-supply-voltage detector coupled to said power supply, said power-supply voltage detector detecting a voltage level by receiving said voltage from said power supply and outputting a power-supply-voltage detection signal when the voltage from the power-supply is greater than or equal to a first reference voltage that is higher than a movement-start voltage; and a modulation-signal generator receiving said termination-storage signal and power supply voltage detecting signal and outputting a modulation signal in response to said power-supply-voltage detection signal from said power-supply-voltage detector being output while said termination-storage signal is being input to said modulation-signal generator, said display-drive receiving said modulation signal and performing modulated driving with respect to said display in response to said modulation signal.

2. A timepiece device according to claim 1, further comprising a reference-signal generator receiving said voltage from the power supply and generating a reference signal when a voltage that is greater than or equal to said movement-start voltage accumulates in said power supply, and said termination-detector receiving said reference signal and outputting said termination-detection signal when said reference signal is not outputted from said reference-signal generator.

3. A timepiece device according to claim 1, wherein, after said power-supply-voltage detection signal from said power-supply-voltage detector is input to said storage unit, said termination-storage signal is reset.

4. A timepiece device according to claim 1, wherein said power supply includes a power-generator and a power-storage unit, and said power-storage unit is charged by said power-generator.

5. A timepiece device according to claim 1, wherein said display includes at least two pointers comprising a minute pointer and an hour pointer, and said modulated driving is performed with respect to at least one of said two pointers.

6. A timepiece device according to claim 1, wherein said modulation-signal generator outputs said modulation signal after said power-supply-voltage detection signal has been continuously output for a predetermined time.

7. A timepiece device according to claim 1, wherein said modulation-signal generator terminates outputting said modulation signal after the power supply voltage detector has detected that the power-supply voltage is equal to or less than a second reference voltage for a predetermined period of time.

8. A timepiece device according to claim 1, further comprising a display control coupled to said display-drive, said display control outputting a display-control signal to said display drive and adjusting time information displayed on said display.

9. A timepiece device according to claim 8, wherein, said display control outputs a reverse-driving signal to said display drive after said modulation signal has been output and adjusts the time information displayed on said display until the time information displayed equals the time that would have been displayed under normal driving of said display.

10. A timepiece device according to claim 8, wherein said display control outputs a display-control signal to said display-drive and terminates the driving of said display until the time information displayed on said display equals the time that would have been displayed under normal driving of said display.

11. A timepiece device according to claim 1, further comprising a switch coupled to said modulation-signal generator for setting time in said display, said switch outputting a switching signal to said modulation-signal generator if said switch is activated for time setting, and said modulation-signal generator terminating outputting said modulation signal when the switching signal from said switch is inputted to said modulation-signal generator.

12. A timepiece device according to claim 1, further comprising a timer, said timer measuring a period of time during which modulated driving occurs and outputting a timer-output signal to said modulation-signal generator, and said modulation-signal generator terminating outputting said modulation signal after a predetermined time.

13. A timepiece device according to claim 1, further comprising a driving-start control, said driving start control controlling said display-drive to be in a normal-driving-inhibited condition when said termination-storage signal is stored in said storage unit.

14. A timepiece device according to claim 1, wherein said display electronically displays the time.

15. A timepiece device according to claim 14, further comprising:

an acoustic device;

wherein said modulation signal generator applies said modulation signal to said acoustic device to provide an acoustic indication of prior halt of said display.

16. A timepiece device according to claim 1, further comprising:

an acoustic device;

wherein said modulation signal generator applies said modulation signal to said acoustic device to provide an acoustic indication of prior halt of said display.

* * * * *